United States Patent [19]

Bowlin

[11] Patent Number: 4,858,313

[45] Date of Patent: Aug. 22, 1989

[54] METHOD OF FORMING A CONNECTOR

[75] Inventor: Robert F. Bowlin, Downers Grove, Ill.

[73] Assignee: Labinal Components and Systems, Inc., Elk Grove Village, Ill.

[21] Appl. No.: 205,211

[22] Filed: Jun. 10, 1988

Related U.S. Application Data

[62] Division of Ser. No. 44,968, May 1, 1987.

[51] Int. Cl.[4] ..... H01R 43/00

[52] U.S. Cl. ..... 29/883; 29/885; 29/874; 29/879; 439/607; 439/608

[58] Field of Search ..... 29/883, 884, 874, 879, 29/880, 885; 439/607, 608, 620

[56] References Cited

U.S. PATENT DOCUMENTS 4,144,509 3/1979 Boutros ..... 439/608

4,494,092 1/1985 Griffin ..... 439/607

4,580,866 4/1986 Hagner ..... 439/620

*Primary Examiner*—P. W. Echols

*Assistant Examiner*—Kevin Jordan

*Attorney, Agent, or Firm*—Neuman, Williams, Anderson & Olson

[57] ABSTRACT

A connector for a multiple-pin electrical member includes an insulating body with opposed end faces, a side face and a plurality of holes extending between the ends for receiving pins from the member. Grooves in one face connect with the holes, and a longitudinal slot divides the grooves into two sections. Conductive material exists in each groove section and on the one face for connection to a ground. In constructing the connector conductive copper and solder plating is layered on the insulating body, and is selectively removed by mechanical action, wherein the slot is ground by a diamond clad wheel and the faces are ground with grinding pads.

10 Claims, 2 Drawing Sheets

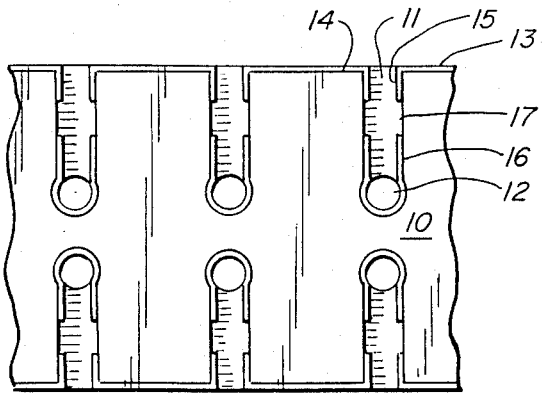
FIG. 1
prior art
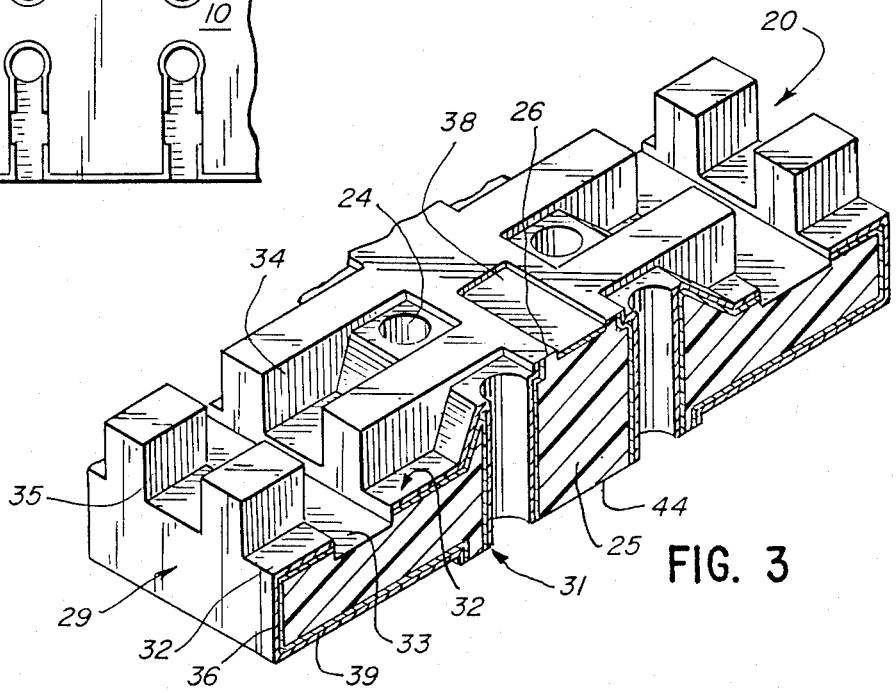
FIG. 3
FIG. 2
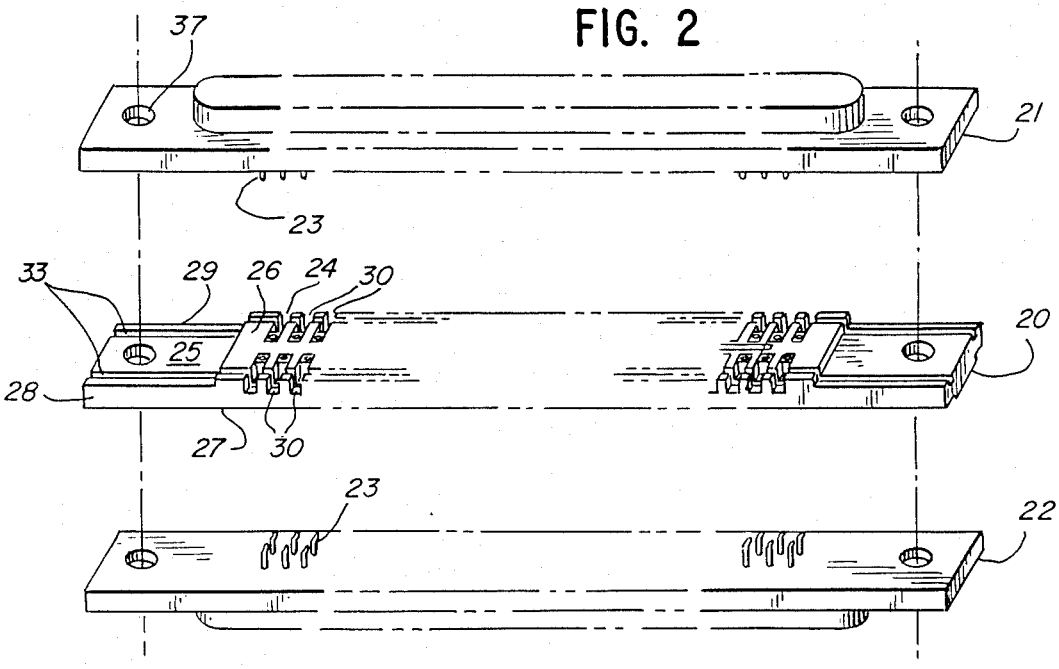

METHOD OF FORMING A CONNECTOR

This is a divisional of application Ser. No. 44,968, filed May 1, 1987.

BACKGROUND

This invention relates to circuit interconnections, particularly electrical connectors. More particularly it relates to connectors for multiple-pin electrical members. Connectors for this purpose are made of an insulating body and are used as adapters, connectors or interconnectors. In one form these connectors provide for filtering electromagnetic and electrostatic noise to ground.

Such connectors are known in the prior art. U.S. Pat. No. 4,580,866 (Hagner) discloses such a connector assembly. A disadvantage of the electrical connector disclosed in that patent is the difficulty in layering conductive materials between two segments of a groove which is to be spanned by the filtering capacitor. To achieve effective conductive plating on each segment of the groove it is necessary to introduce mask elements into each groove. This is complex and expensive.

Other prior art connectors of this nature use an insulating body and employ progressively layers of copper and solder plating. Chemical processes are then used to remove selectively undesired copper plating or solder plating. A disadvantage of this process is a high reject rate due to continuity voids in part of the plating and thus a high wastage rate.

It is accordingly an object of the present invention to provide for circuit interconnections, an electrical connector and a method of manufacturing this circuit interconnection connector with a higher yield of finished product, and by a construction process which is efficient.

SUMMARY

By this invention a circuit interconnection in the form of a connector block is provided which reduces the disadvantages of prior art connector blocks. The invention provides an electrical component and method for producing the electrical component which has the advantages of efficient and simplified manufacturing with a relatively low reject rate.

According to the invention there is an electrical component for multiple connection electrical members wherein the component has an insulating body and multiple grooves. A transverse isolating slot is provided to divide the grooves into two sections which are electrically isolated.

Further according to the invention the component is a connector member for a multiple-pin electrical member wherein the insulating body has opposed end faces, a side face and a plurality of holes extending between the end faces. Each hole is adapted to receive a pin of the electrical member. One of the faces has grooves corresponding to each hole and the grooves extend transversely to the side face of the body. Each hole and groove is provided with a layer of electrical conducting material. The transverse longitudinal slot divides the grooves into two sections. The groove section adjacent the side face is adapted for grounding through the side face. Capacitors connected between that groove section and the groove section adjacent to the hole permit for the pins connected through the holes to be grounded through capacitors in the respective grooves.

The insulating body is molded and suitably annealed to prevent cracking during plating. Plating of the insulating body is effected and thereafter a diamond tip grinding wheel removes plating from the transverse longitudinal slot. A grinding pad and action of a coolant removes selective plating from at least one face. Solder plating is then imparted to selected portions of the member, and once again grinding under the action of a pad with coolant removes plating from selected portions of the face.

By removing plating through the described mechanical processes as opposed to chemically removing plating, an efficient and effective method of manufacture is achieved. Additionally it is not necessary to provide masking of a selected area of grooves to achieve the requisite conductive structure for the connector.

DRAWINGS

FIG. 1 is a sectional top view of a portion of a prior art connector showing the transverse grooves.

FIG. 2 is a perspective view of a connector with multiple-pin electrical members to either side of the connector for connection with the holes in the connector.

FIG. 3 is a fragmentary sectional perspective view of a portion of the connector showing the slot and groove configuration in enlarged detail.

DETAILED DESCRIPTION

Figure 4:
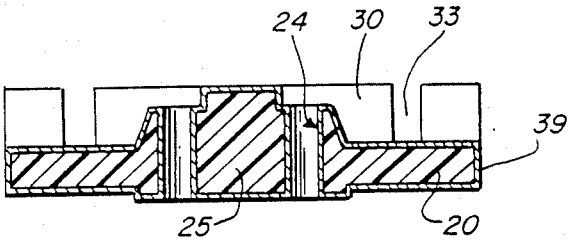
FIG. 4 is a view similar to FIG. 3, with an electroless copper coating on the entire structure, namely at an early stage in the manufacturing process.

In FIG. 1 the prior art for the connector illustrates a body 10 with transverse grooves 11 connected with holes 12. A layer of plating 13 is placed on the side 14 of the body 10 and extends inwardly at 15 into groove 11. A plating material 16 extends on the groove wall adjacent the hole 12. Between the plating layers 15 and 16 is a space 17 which cannot be plated by the plating process. It is therefore necessary to fill the space 17 with a mask during plating. This is a relatively difficult and consequently unnecessarily costly step in the manufacturing process for the connector.

Referring to FIG. 2 the electrical component of the invention is there illustrated as a connector electrical component 20 which is sandwiched between multiple-pin electrical members 21 and 22. The pins 23 extend from the electrical members 21 and 22 to engage in corresponding holes 24 in the connector block 20.

The connector 20 includes an electrically insulating body 25, the body 25 having opposed end faces 26 and 27, and opposed side faces 28 and 29. The holes 24 extend between the faces 26 and 27. The end face 26 has spaced multiple grooves 30 extending laterally from corresponding holes 24 to both the side faces 28 and 29 of the body. Each hole and groove contains an electrically conducting material generally indicated by numerals 31 and 32 respectively. A longitudinally directed slot 33 intersects the grooves 30 thereby dividing the grooves 30 into a section 34, which is adjacent the holes 24 and a section 35 which is adjacent the sides 28 and 29 respectively. The side faces 28 and 29 are provided with a conductive material 36 which is in contact with the conductive layer 32 in the groove section 35.

A capacitor can span the two groove sections 34 and 35 across the intersecting slot 33. The conductive material 36 is connected through aperture 37 with a grounded body member, and thereby a ground passes through the side faces 28 and 29 to the groove sections 35 adjacent the side faces 28 and 29. The ground passes through the capacitor located in the groove 30 to the conductive material 32 in the corresponding groove section 34 and in turn to the holes 24 and the pins 23 of the electrical members 21 and 22 when they are connected in the holes 24. Electromagnetic and electrostatic interference and noise is thus effectively passed to ground for each circuit connected in this manner.

The process of manufacturing the connector member 20 includes molding the component block 25 from an insulative material which is supplied by Union Carbide and marketed under their product name, Mindel M-825 (tradename). This polysulphane material is a polyester mineral-filled platable grade material. It can be a glass-filled polyester. Another suitable material would be that produced by General Electric namely, Ultem (tradename).

The block 25 is molded to have the structure of the two opposed ends 26 and 27, and opposed faces 28 and 29. The transverse grooves 30 are formed in the molding, as well as the longitudinal slot 33. Various other indentions 38 and apertures 37 are provided so that the connector 20 meets the requirements for connection with the multiple-pin electrical member. The depth of the slot 33 is equal to the depth of the grooves 30. Holes 24 are formed in the molding process.

The next step is to anneal the material 20 to prevent cracking during plating operations or etching operations that may occur on the connector 20. Annealing is effected at about 300° fahrenheit for approximately 3.5 hours.

Figure 5:
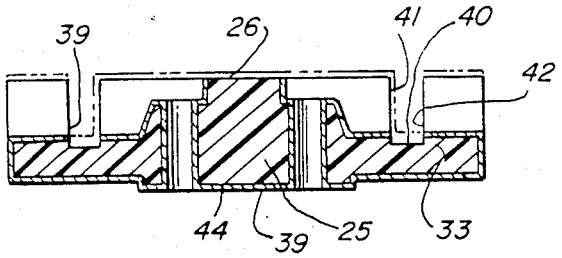
FIG. 5 is a view similar to FIG. 4 showing the connector further developed in the manufacturing process.

An electroless copper plating layer is provided over the entire insulating body 20. This is illustrated in FIG. 4 as the layer 39. This fills the slot 33 and the bores of holes 24. The electroless copper plating is ground from the recessed slots 33 using a diamond clad grinding wheel. At this stage the slots 33 are ground to a depth deeper than the grooves 30. The diamond wheel does not operate on the flat faces 26 or 27 of the insulator body 25. FIG. 5 illustrates this stage of production with copper plating around the body 25 of the insulator 20 and removed from the base 40 of the slot 33. In the illustration the copper plating is also removed from the sidewall 41 of the slot 33 and is retained on the opposite side wall 42 of the slot 33. In other various embodiments the copper plating 39 can be removed from both sidewalls 41 and 42 of the slot 33.

In the next step of the process, also as illustrated in FIG. 5, copper plating is removed from the uppermost face 26 of the connector. This process is effected by a wet grinder and silicone carbon grinding pad with coolant disbursed over the connector during the removal process.

Figure 6:
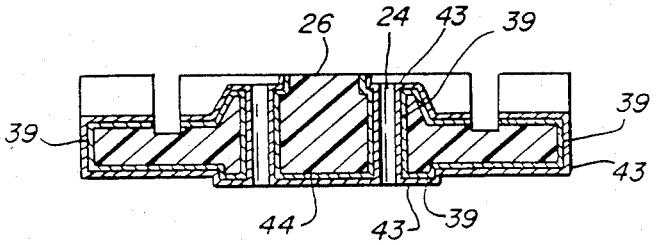
FIG. 6 is a view similar to FIG. 5 at a further stage in the process.

In FIG. 6 there is illustrated the provision of a layer of solder or tin plate 43 over the entire insulator body 25 except for the surface 26 and in the slots 33. In this manner certain sections of the insulator body 25 have a double layer, being formed by layers 39 and 43 whereas in the slot 33 from which the copper plating 39 had been removed and the face 26 from which the copper plating 39 had been removed has no material. The face or surface presented by these portions is the insulating material 25. The holes 24 are provided with the two layers 39 and 43 so that effective good contact can be made with the pins 23 which subsequently inserted in the holes 24. So as to insure effective electrolytic copper and solder plating 43 of the insulator body 25 and the layer 43 into the holes 24, plating 39 is on the base 44 of the insulator 20. Thus good contact can be made with the body 25 for the electrolytic copper and solder plating of the entire insulator body 25.

Figure 7:
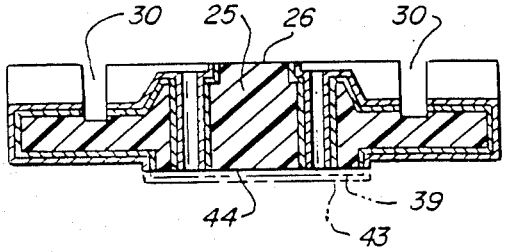
FIG. 7 is a view similar to FIG. 6 at the final stage in the process.

The final step of the operation which is illustrated in FIG. 7 is the removal of the electroless copper layer 39 and electrolytic copper and solder layer 43 from the base 44 of the insulator body 20. This removal is effected by a grinding pad, and coolant can be provided.

By this process a mechanical action is used to process the insulator block 25. This is opposed to chemical processing to provide effective faces of the block with suitable conductive and non-conductive properties. This overcomes the problems with the prior art and the chemical processes associated with this formation of the component. Likewise, difficult and intricate masking operations do not have to be applied to the insulator block to achieve the requisite block conductive-non conductive facings. Consequently from this perspective the block is also more simply manufactured than the prior art blocks.

The block illustrated shows two relatively flat faces 26 and 27. In different structures of the block a relatively thicker insulating body 25 is used. Also, in a different structure the lower end face 44 is not planar. Rather the opposite end or bottom end face 44 includes a section with a perimeteral edge running around the outer extremities of the block 25. Upstanding longitudinal ridges are internally spaced from a perimetral ridge and from each other within the perimeteral edge.

In a different application of the connector member it may form an adaptor between electrical multiple-pin members connected through the block from both ends, as indicted in FIG. 2. In other applications the electrical members are connected from only one end. Different electrical multiple pin members can be used with the electrical connector block, according to various applications.

By grounding the insulator block through the holes 37 which have conductive material passing through their bore which is in turn connected through the conductive layers 39 and 43 on the ends 25, 27 and faces 28 and 29 and in turn to the groove sections 35, effective grounding can be achieved.

In another embodiment the electrical component provides multiple spaced grooves 30, and the slot 33 electrically isolates the grooves into two sections. Such an electrical component can have different applications. Also, instead of a capacitor extending between the groove sections, different electrical circuit elements may bridge the slot as required.

In other embodiments of the invention it is possible to layer selective parts of the ends of the insulator body with a plating resist. This can be done by silk screening on the central raised portion in face 26 and the lower most portion of face 44 of the ends of block 25.

Many changes and variations may be made in the electrical connector, and the method for providing the connector of this invention without departing from the scope thereof. All matter contained in the above description as shown in the accompanying drawings should be interpreted as illustrative but not limiting, the invention being interpreted solely by the scope of the appended claims.

What is claimed is:

1. A method of forming a connector member for a multiple-pin electrical member comprising forming an insulating body with opposed ends, a side and a plurality of holes extending between the ends, one of the ends having spaced grooves, the grooves extending laterally from the holes to the side of the body, an a slot directed to intersect the grooves thereby to divide each groove into two sections, plating the insulating body, removing plating material from the slot, removing plating material from a selected area of at least one end, solder plating the plated layer, and removing selected plating material and solder plating material from at least one end.

2. A method as claimed in claim 1 including molding the insulation body and annealing insulator body after molding.

3. A method as claimed in claim 2 wherein the plating is a copper material deposited by an electroless process.

4. A method as claimed in claim 3 wherein the electroless copper from the recessed slot is removed by a diamond clad grinding wheel.

5. A method as claimed in claim 4 wherein copper plating and solder plating from the faces is removed by a grinding pad.

6. A method as claimed in claim 5 wherein coolant is dispersed over the body during grinding of the faces.

7. A method as claimed in claim 1 including forming the slot deeper than the depth of the grooves.

8. A method of producing a connector for a multiple-pin electrical member comprising molding a body of electrically insulating material, the body having a pair of opposed end faces, a side face and a plurality of holes extending between the end faces, each hole being adapted to receive a pin of the electrical member, one of the faces having grooves therein extending laterally from the holes to the side face of the body, and a slot directed to intersect the grooves thereby to divide the grooves into two sections, plating the insulating body with copper plating and solder plating and selectively removing copper plating or copper plating-solder plating from selected portions of the body by mechanical action on the plating layers.

9. A method of forming an electrical component for a multiple connection electrical member comprising forming an insulating body with an end and a plurality of spaced grooves in the end, and a slot directed to intersect the grooves thereby to divide each groove into two sections, plating a material on the insulating body, removing plating material from a selected area of the end, solder plating the plated material, and removing selectively at least one of the plating material or plating material-solder plating from the end.

10. A method as claimed in claim 9 wherein the removal of plating material is effected mechanically.

* * * * *